US006131308A

United States Patent [19]

Kramer et al.

[11] Patent Number: 6,131,308

[45] Date of Patent: Oct. 17, 2000

[54] APPARATUS FOR LEVITATIONAL GUIDANCE OF WEB MATERIAL

[75] Inventors: Carl Kramer, Aachen, Germany; Eckehard Fiedler, Vaals, Netherlands

[73] Assignee: Ingenieurgemeinschaft WSP, Prof. Dr.-Ing C Kramer, Prof. Dipl.-Ing H.J. Gerhardt M.S., Aachen, Germany

[21] Appl. No.: 09/393,519

[22] Filed: Sep. 10, 1999

[51] Int. Cl.[7] ..... F26B 13/00

[52] U.S. Cl. ..... 34/633; 34/638; 34/643

[58] Field of Search ..... 34/633, 635, 636, 34/638, 643, 648, 649; 242/615.1, 615.11, 640, 654

[56] References Cited

U.S. PATENT DOCUMENTS

| | | | |
|---|---|---|---|
| 4,523,391 | 6/1985 | Smith et al. | 34/638 X |
| 5,134,788 | 8/1992 | Stibbe et al. | 34/524 |
| 5,150,534 | 9/1992 | Kramer . | |
| 5,261,166 | 11/1993 | Seeley et al. | 34/629 X |
| 5,370,289 | 12/1994 | Helms | 226/97 |
| 5,564,200 | 10/1996 | Strahm | 34/643 X |
| 5,946,819 | 9/1999 | Reimer et al. | 34/633 X |
| 6,058,626 | 5/2000 | De Vroome et al. | 34/649 |

FOREIGN PATENT DOCUMENTS

| | | |
|---|---|---|
| 543 931 | 1/1956 | Belgium . |
| 976 048 | 1/1963 | Germany . |
| 24 46 983 | 4/1976 | Germany . |
| 40 10 280 | 10/1991 | Germany . |
| 196 23 303 | 1/1997 | Germany . |
| 07242951 | 9/1995 | Japan . |

*Primary Examiner*—Stephen Gravini
*Attorney, Agent, or Firm*—Renner, Otto, Boisselle & Sklar, LLP

[57] ABSTRACT

An apparatus for levitational guidance of a continuous web of material for the purpose of its heat-treatment is configured of individual zones. The form ducting of the zones has the shape of an U in the vertical longitudinal center section above and below the web in each case, the legs of the U being located parallel to the transport direction of the web. The legs adjacent to the web are equipped on the side facing the web with levitation nozzle ribs or nozzle areas. In the legs facing away from the web, a radial fan is incorporated in each U, the delivery direction of which is directed towards the turn joining the two U legs. Heating means are arranged to advantage in the heating zones in the region between the two legs of the U. Coolers may be incorporated to advantage in the region of the turn joining the two U legs.

13 Claims, 5 Drawing Sheets

A - A

APPARATUS FOR LEVITATIONAL GUIDANCE OF WEB MATERIAL

BACKGROUND OF THE INVENTION

1. Field of the Invention

The invention relates to an apparatus comprising at least one jetting section for levitational guidance and stabilization of a continuous web of material for the purpose of its heat-treatment, the apparatus comprising levitation nozzles for jetting the web at least on one side with a treatment gas and a radial fan arranged on the jetting side of the web including a 360° spiral housing for feeding the levitation nozzles.

In such an apparatus the web is maintained levitated by being jetted with treatment gas from below, and also from above, where necessary, while being simultaneously heat-treated. Heat treatment may involve heating and maintaining the annealing temperature as well as subsequent cooling for metallurgical reasons or also for the purpose of surface treatment, e.g. in drying a web coating.

2. Description of the Prior Art

An apparatus of this kind is, as a rule, configured of individual sections in sequence, and as is evident from e.g. German disclosure DE-OS 2446983 or DE 4010280 A1, each section contains a form duct including at least one fan and systems of levitation nozzles arranged above and below the web transversely to the transport direction thereof with which the web is jetted with the gas circulated by the fan for the purpose of the convective heat exchange and at the same time is stabilized by the effective flow forces.

In particular, those apparatus for operation at high gas temperatures are generally equipped with radial fans to meet the technical strength requirements.

Although in the apparatus as disclosed by DE-OS 2446983 a particularly compact design is achieved by arranging only one fan at the side of each section, since one fan supplies top and bottom levitation nozzles at the same time, however, there is no possibility of simply regulating the supporting force, e.g. in adapting it to the weight of the web to be levitationally guided by changing fan speed, since this affects both the top and bottom nozzle systems in the same way. In addition to this the apparatus as disclosed by DE-OS 2446983 has the drawback that the return flow of the treatment gas jetted against the web occurs only on one side to the fan. This results in a heat exchange between the return flow from the web and the supply flow to the nozzles ribs, as a result of which a drop in temperature of the jetted gas occurs along the nozzle ribs from the side facing away from the fan to the side of the fan e.g. in a heating zone in which the down flow from the web is colder than the supply flow jetted to the web.

Although the apparatus as disclosed by DE 4010280 A1 obviates this disadvantage by alternating the supply flow to the nozzle ribs within a section, this requires four fans for each section and is thus suitable only for systems for levitationally guiding very wide webs where this added technical complexity is worthwhile due to the larger surface areas to be jetted and the thus higher gas flow rate required. One major drawback of this apparatus, having nozzle ribs supplied at the side, is that complicated systems of guide vanes need to be employed to return the jetted flow perpendicularly back to the surface of the web, which in addition to added costs also causes appreciable pressure losses. It is however especially in the case of systems for the treatment of non-ferrous webs of brass, copper, bronze, German silver and similar materials that the width of the web is limited due to the rolling width usually being considerably smaller than that of aluminium or steel webs, so that the apparatus as disclosed by DE 4010280 A1 is hardly suitable for levitational guidance of the majority of non-ferrous metal webs which are usually relatively heavy and narrow.

SUMMARY OF THE INVENTION

The invention is thus based on the object of providing an apparatus of the aforementioned kind which avoids the cited disadvantages, the intention being more particularly to provide an apparatus which is relatively uncomplicated from a technical point of view and compact, enabling the flow to be adapted on both sides to the weight of the web or enabling simple regulation of the supporting force by varying the fan speed.

This is achieved wherein the radial fan is disposed on each jetting section in the transport direction of the web at one longitudinal end of each jetting section with an internal intake opening, the radial fan is arranged so that it delivers in the one direction located substantially parallel to the transport direction of the web, and the flow from the radial fan is returned at the other longitudinal end of each jetting section U-shaped to the web so that in the region of the levitation nozzles the flow again runs substantially parallel to the transport direction of the web opposite the flow from the radial fan. Advantageous aspects of the design read from the sub-claims.

Arranged in each zone perpendicular to the plane of the web above and below thereof on the ceiling and the floor respectively of a section of the apparatus is a radial fan, preferably a compressor drum-type radial fan.

The delivery cross-section of the spiral housing of the radial fan is oriented so that delivery is made into a ducting length, which is at least as long as roughly a hydraulic diameter, substantially parallel to the transport direction of the web.

Connecting this ducting length at an end wall of a section of the apparatus is a device for returning the flow through 180° i.e., contrary to the direction of delivery from the radial fan, a further duct being provided at the end of this 180° return which is likewise oriented parallel to the transport direction of the web and extends over the full length of the section. This duct forms in conjunction with the 180° return and the 360° spiral housing with the adjoining delivery duct, as viewed in the vertical longitudinal center section of the apparatus, a horizontally located U, the two legs of which are oriented parallel to the transport direction of the web. On the side of the duct adjoining the 180° return facing the web, the nozzle array is arranged. This nozzle array may consist of levitation nozzles as usual in prior art, but preferably consists of a levitation nozzle array incorporating nozzle areas having the shape of the axial section through a double truncated cone or a barrel, the base of the double truncated cone or the largest diameter of the barrel being located in the middle of the levitation nozzle.

Provided between the levitation nozzles ribs or the nozzle areas in both cases are return flow passageways open towards the web, the cross-section of which may be flared towards the edges of the web.

A nozzle area may also be used as the nozzle array in which nozzles are clustered partly around down flow openings. These down flow openings are formed by the inlet cross-section in passageways which pass through the supply duct perpendicular to the plane of the web. In this case the return flow from the web to the fan occurs partly through these passageways, the return flow being split into the proportion flowing back laterally to the web and the proportion flowing through the return flow passageways passing through the supply duct to dictate the supporting force characteristic of the levitation nozzle array.

In any case, however, the more substantial portion of the down flow occurs to both sides of the apparatus and gains access from the space laterally alongside the flow duct to the portion between the two legs of the U to which the intake opening of the radial fan is oriented.

The respective spaces arranged each on both sides of the web and flow ducting and encompassed by the outer walls of the apparatus are accessible and may be used for maintenance and inspection tasks.

When the apparatus is heated by burners, heating means are incorporated in at least one side wall of the outer housing and protrude into the space between the legs of the U-shaped ducting.

When heated electrically, the electric heating register is incorporated either in the region of the return of the U-shaped flow ducting or arranged on the suction side upstream of the fan.

In sections configured as cooling zones, having a closed flow circuit, the cooler for the circulating gas is incorporated in the region of the U-shaped return, wherein to increase the installed surface area, the cross-section of the flow ducting—as viewed from the fan—may be flared towards the inlet cross-section of the cooler. Here again it is also possible to arrange the cooler on the suction side upstream of the fan.

The levitation nozzles may protrude laterally beyond the flow ducting by which they are supplied.

At the beginning and end of a sectioned apparatus gas jet seals may be mounted at the web inlet and outlet openings, this embodiment being particularly advantageous when any gaseous exchange between the interior of the apparatus and the outer environment or between adjoining zones of an apparatus comprising several such zones is to be avoided.

DESCRIPTION OF THE PREFERRED EMBODIMENTS

Figure 1:
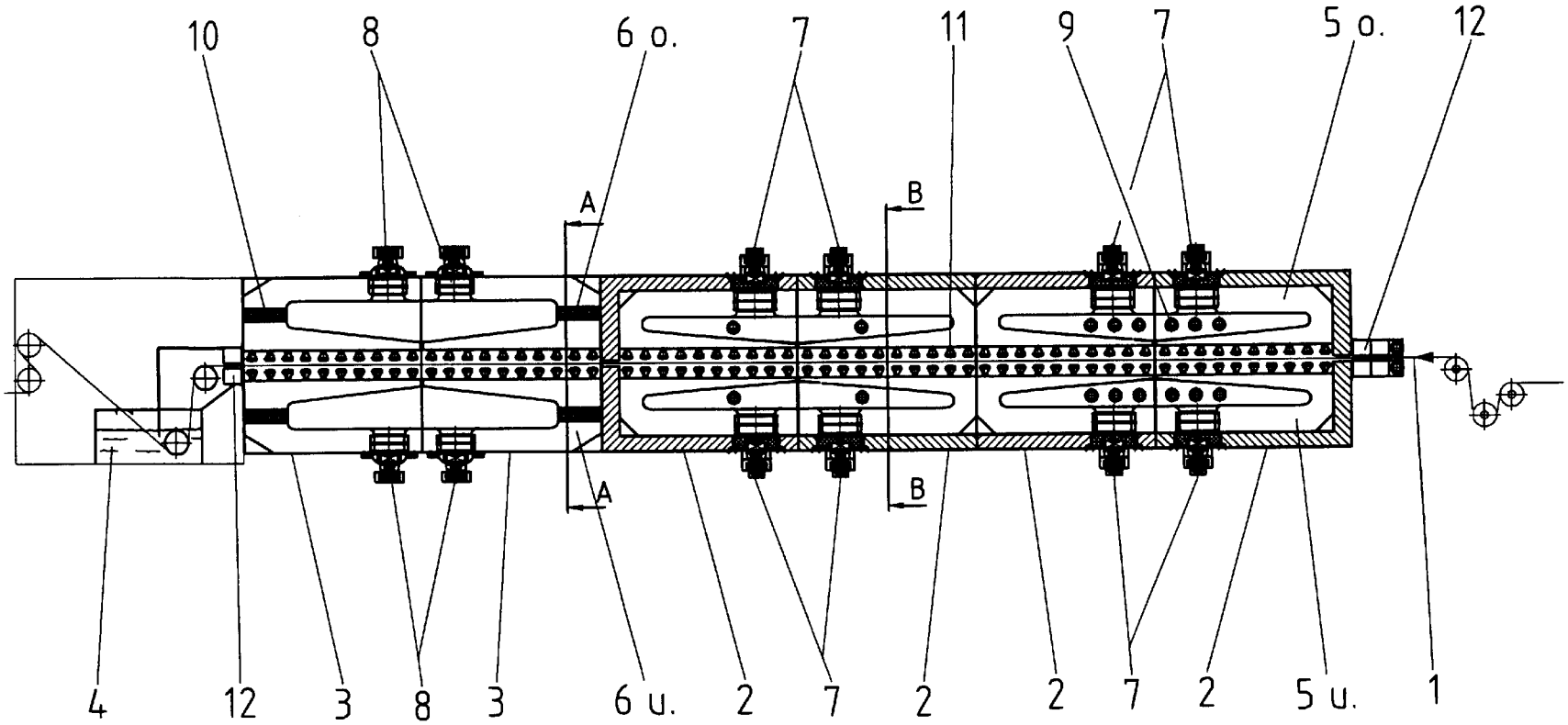
FIG. 1 is a vertical longitudinal section through a heat treatment oven including heating and cooling zones

The apparatus as illustrated in FIG. 1 serves to levitationally guide and stabilize narrow to medium-wide metal webs, i.e., metal webs having a width of between approx.250 mm and 1250 mm. As is evident from FIG. 1, this apparatus comprises four heating zones 2 and two cooling zones 3. A web 1 is transported through the apparatus horizontally from right to left. At the end, downstream of the last cooling zone 3, the apparatus is closed off by a water lute 4 through which the web 1 is guided by means of a dip roll. The usual rolls for locating and tensioning the web are arranged upstream of the entry into the first heating zone or oven zone.

In addition, a gas jet seal 12 may also be advantageously mounted to the beginning and the end of the apparatus in operation of the heat-treatment oven, namely heating and/or cooling zones, in an inert gas atmosphere. The gas jet seal 12 at the entrance is intended to prevent the inert gas atmosphere, preferably having an exceedingly small percentage of oxygen, from being contaminated by ambient air. The gas jet seal 12 at the outlet of the apparatus advantageously prevents ingress of water vapor from the housing of the water lute 4 into the cooling zone 3 which would otherwise disadvantageously elevate the dew point of the inert gas atmosphere.

Each zone 2, 3 of the apparatus comprises two U-shaped flow ducts 5o and 5u or 60 and 6u above (5o, 6o) and below (5u, 6u) the web respectively. Incorporated in the legs of this U facing away from the web 1 are heating or oven fans 7 and cooling zone fans 8 respectively. The delivery direction 19 of the fan 7, 8 in a U-shaped flow duct 5o and Su or 60 and 6u is in the direction of the turn joining the two legs of the U, it being in this turn, as indicated by the flow arrow 21 in FIG. 2, that a change in the flow direction is returned through 180° into the inlet of a flow duct 25 which represents the second leg of the U and which supplies the nozzle ribs 11 with the treatment gas.

Figure 2:
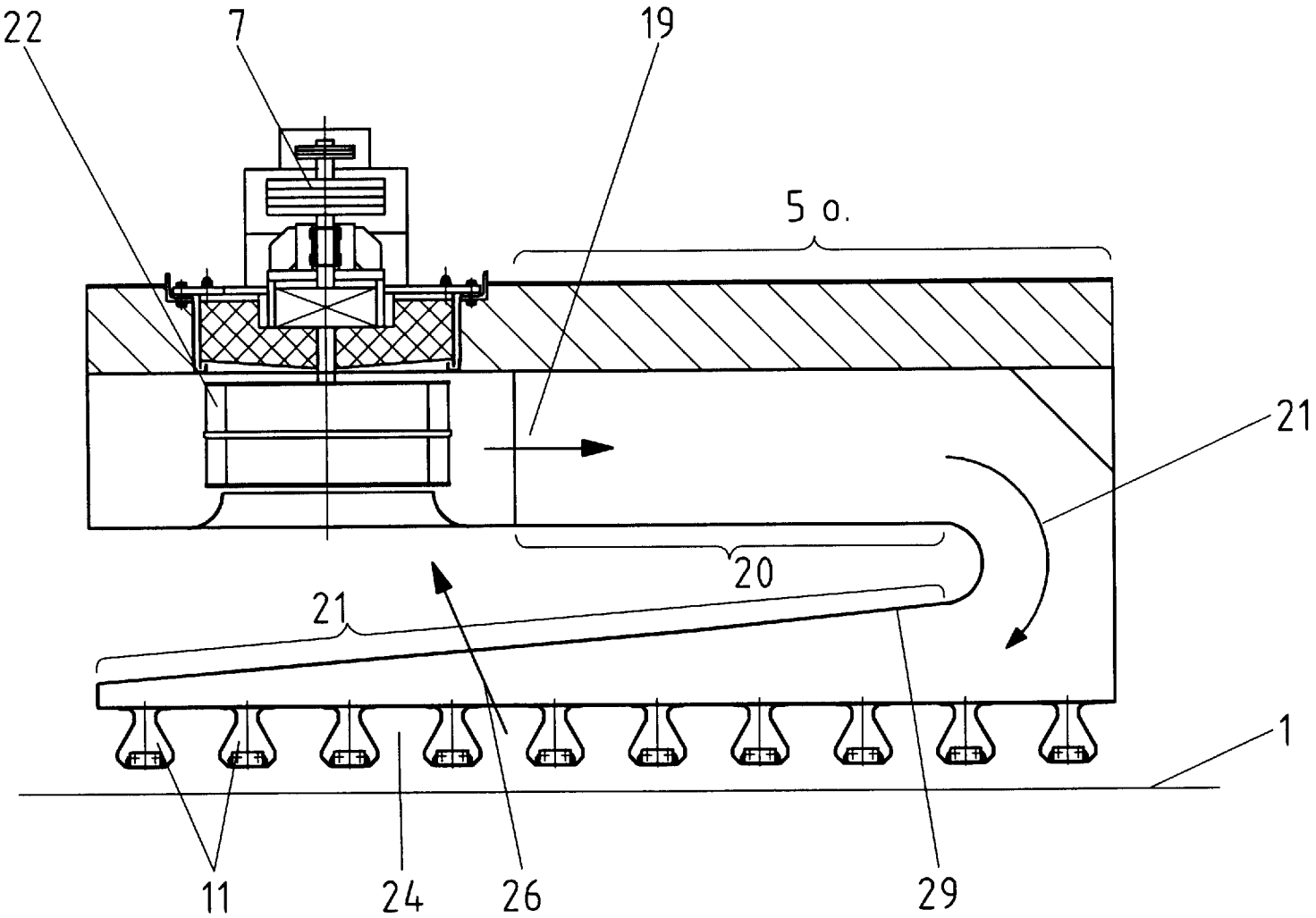
FIG. 2 illustrates, on a magnified scale, the U-shaped flow duct in the upper half of the first heating zone as shown in FIG. 1.

The great advantage afforded by this U-shaped flow duct is that a fan 7, 8 may be employed, preferably a compressor drum-type fan which may be built particularly compact as regards its handling capacity, in a 360° spiral housing identified in FIG. 2 by the reference numeral 22. To enable each fan 7, 8 to develop its full power, the straight delivery section 20, having the length of roughly a hydraulic diameter, is provided in the upper U leg, as evident from FIG. 2, up to the flow return 21.

Referring now to FIG. 2, it is particularly evident that a somewhat U-shaped flow turn plate 29, arranged in each section of the apparatus, serves to create the U-shaped flow duct 5, 6. The upper, flat horizontal surface area of this flow turn plate 29 runs parallel to the outer wall of the apparatus and forms, together with the inner surface area of this outer wall, the straight delivery section 20, the length of which corresponds roughly to a hydraulic diameter. Returning the flow through 180°,as indicated by the flow arrow 21, occurs, as already mentioned, at the turn joining the two legs of the U-shaped flow turn plate 29 , so that the jetting gas flows between the lower leg of the U-shaped flow turn plate 29 and the nozzle areas of the levitation nozzles 11. The lower leg is - as of the 180° flow return—slightly inclined downwards so that a manifold 25 materializes which is slightly throated at the end in connecting the radial fan 7, as a result of which the higher gas velocity serves to compensate the pressure loss at the levitation nozzles 11 over the full length of a section 2, 3.

As is evident from FIG. 1, the turns joining the legs of the U-shaped flow turn plate 29 at two adjoining sections are located at opposite end of both sections so that the side view has roughly the shape of an inverted flat iron.

From the illustration in FIG. 1 of the jetting of web 1 from both sides, it is evident that the flow ducts 5*o*, 5*u*, 6*o*, 6*u* point in the same direction on both sides of the web 1, i.e., are disposed mirror-symmetrical relative to the web 1.

In the oven or heating zones 2, indirectly gas-heated radiant heating tubes 9 are arranged in the region between the two legs of the U in the case of the example as illustrated in the drawings. The cooling zones 3, having closed-circuit gas guidance, contain in each U a cooler 10 arranged at the turn joining the two U legs. This cooler 10 may be designed as a slat or finned-type tubular cooler or in another usual form.

Figure 3:
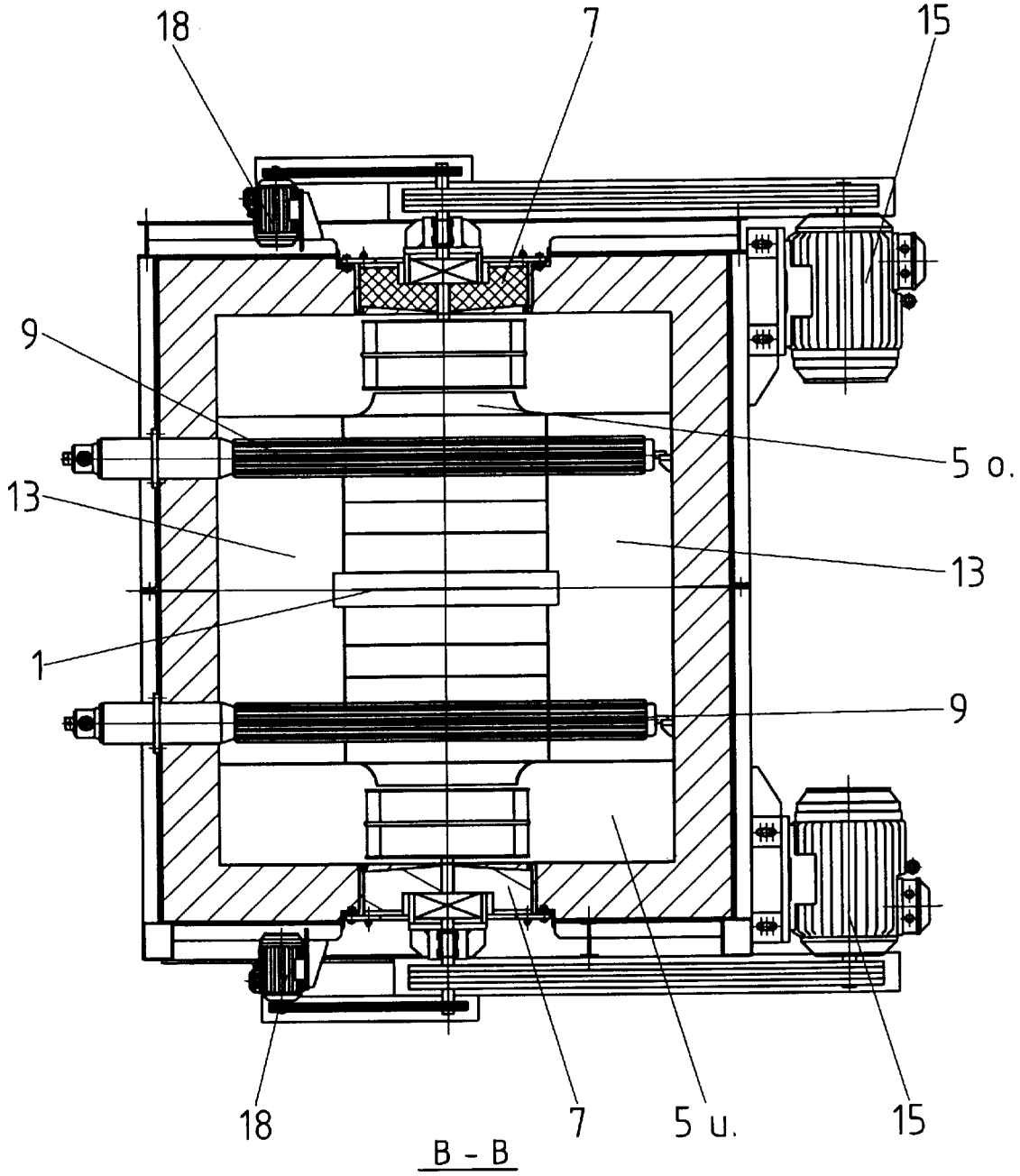
FIG. 3 is a vertical cross-section through a heating zone.

In a cross-section through a heating zone 2 (FIG. 3) in which spaces 13 laterally juxtaposing the U-shaped flow duct 5*o* and 5*u* are to be seen. These spaces 13 are accessible in the usual way via manholes which can be bolted gas-tight and allow facilitated means of inspecting and cleaning the apparatus as well as facilitated access for maintenance work.

In the example illustrated, the radial fan 7 is operated by a belt drive. The motor 15 of the fan 7 is mounted to advantage on one side of the apparatus so that removing the fan 7 merely necessitates dismantling the vee belts and the heavy motor 15 can remain in place together with its electrical connections.

Also evident from the illustrated example is a standby motor 18 which is powered by a standby generator to ensure continuing rotation of the fan 7 if, e.g., due to a power failure, the plant should unintentionally come to a standstill. Thus, this standby motor 18 prevents the fan 7 coming to a halt and damage resulting from high temperatures in the inside of the oven.

Figure 4:
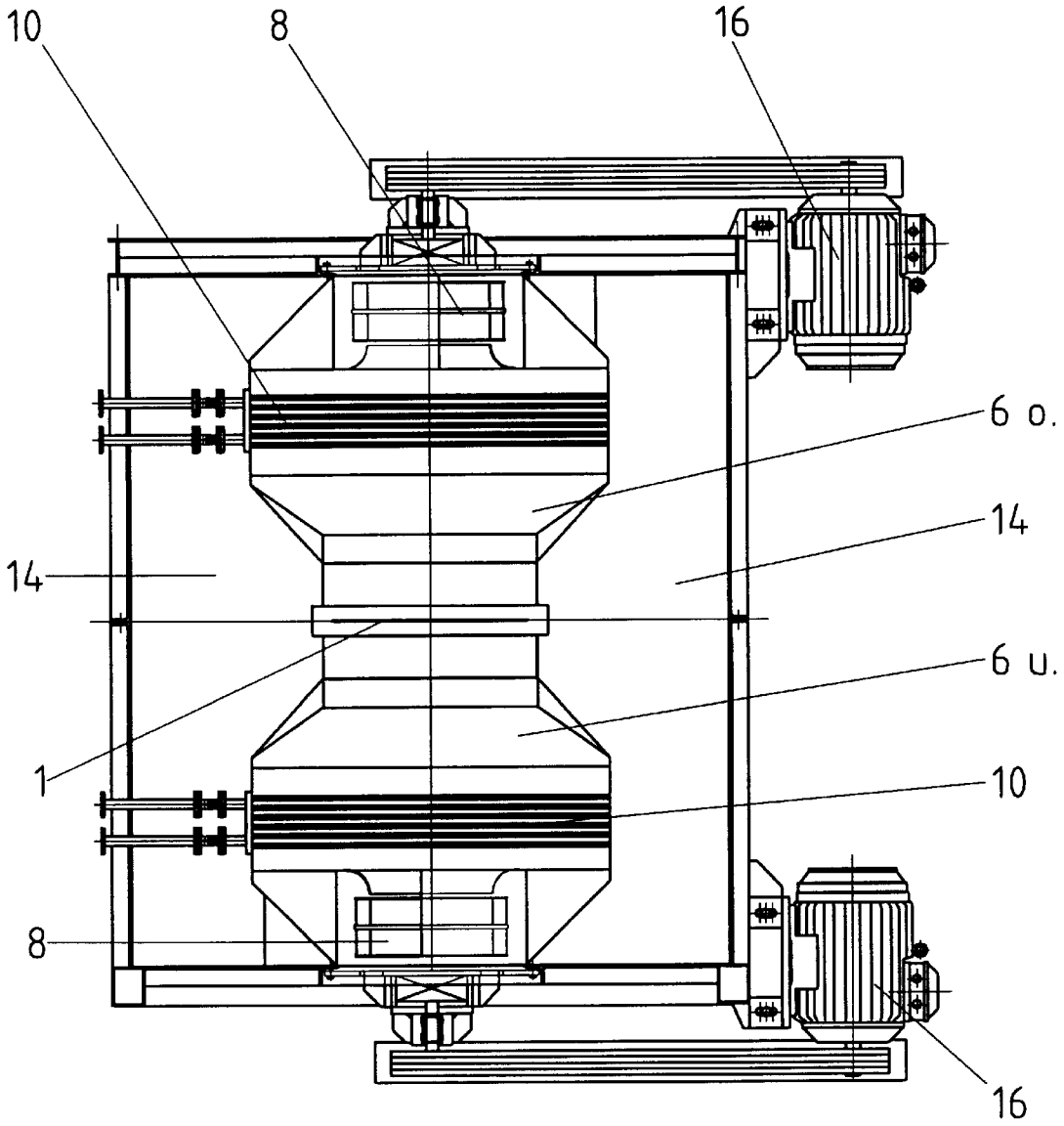
FIG. 4 is a vertical cross-section through a cooling zone.

FIG. 4 illustrates in cross-section the configuration of the cooling zone 3 which essentially corresponds to that of the heating zone 2. Here too, the fan 8 has a belt drive by a motor 16 arranged on one side. Inspection and access spaces 14 materialize in the region between the U-shaped duct 6o or 6u and the outer housing.

The apparatus may be equipped with a variety of levitation nozzle systems. FIG. 2 shows an arrangement of levitation nozzle ribs 11 known already from the prior art. These nozzle ribs 11 incorporate slotted nozzles or orifice nozzles or a combination of both, standing transversely to the run of the web and equal in width over the full working width. When levitation nozzles 11 are arranged on both sides of the web 1 they are expediently staggered by half a center-spacing so that, as is known in general from prior art, a transverse waveform stabilizing the run of the web may be exerted on the web 1 where a thin web is involved which is moved through the apparatus with low tension.

The down flow of the gas flow jetted from the nozzle ribs 11 to the web may be handled by the return flow passageways 24 configured between the nozzle ribs 11. From these return flow passageways 24, the gas laterally bypasses the manifold 25 between the nozzle area and the flow turn plate 29, which as evident from FIG. 2 has a height which is reduced in the direction of flow in the manifold 25. After this, the gas down flow, as indicated by the flow arrow 26, enters the intake area 22 of the radial fan 7, namely in its 360° spiral housing.

Figure 5:
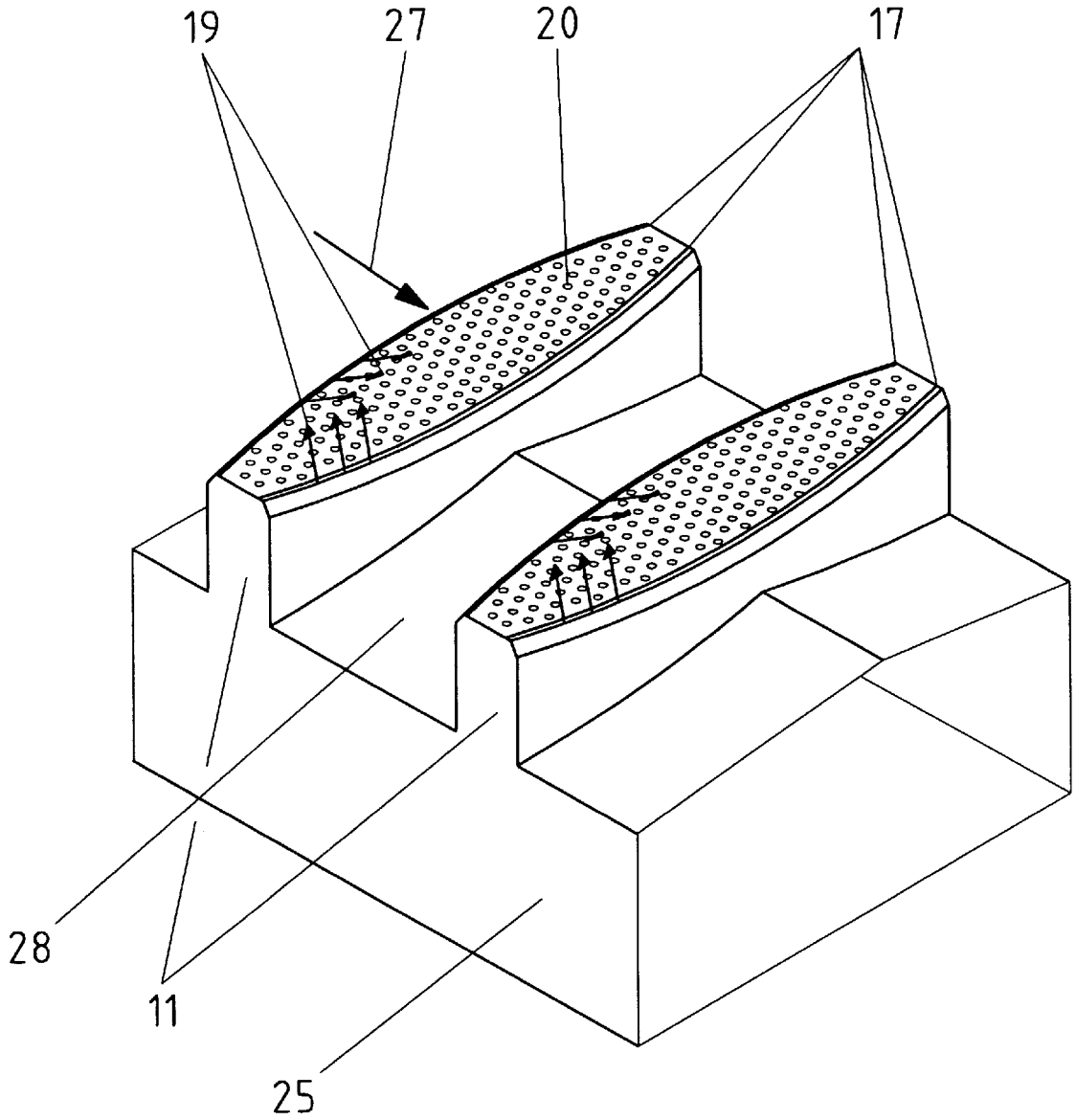
FIG. 5 is a detail, shown in perspective, of a levitation nozzle array.

FIG. 5 illustrates a novel levitation nozzle array in which nozzle areas, whose width varies transversely to the transport direction of the web as indicated by the arrow 27 in FIG. 5, are lined up in sequence in the transport direction of the web. These nozzle areas are encompassed by slotted nozzles 17 over part of their periphery. The nozzle areas themselves are equipped with orifice nozzles.

For the return flow, return flow passageways 28 are provided between the nozzle areas, the cross-section of these return flow passageways being flared from the middle of the supply to both edges, since the upper side of the manifold 25 has the shape of a gable roof, as is evident from FIG. 5.

As viewed from above the nozzle areas have an elongated, tapered shape formed for instance by an axial section of double truncated cone or a barrel, the base of the double truncated cone or the largest diameter of the barrel being located in the middle of the levitation nozzle 11.

The slotted nozzles 17 extend over the full periphery of the nozzle areas except for their obtuse ends, as is evident from FIG. 5.

In conclusion, it is also possible to configure the apparatus with a full-length levitation nozzle area forming the side of the manifold 25 facing the web 1. To facilitate the return flow, passageways may be arranged in the middle of this surface area, these passageways passing through the nozzle manifold 25 in a direction perpendicular to the web to thus permit down flow of part of the gas flow jetted to the web 1 by the nozzles directly to the intake area of the radial fan 7, 8. A large proportion of the volume of flow jetted in all to the web flows off, the same as before, at the sides and reaches the intake area of the radial fan 7, 8 as indicated by the flow arrow 26.

In this embodiment, the nozzles are expediently arranged in a cluster around the return flow passageways passing through the nozzle manifold, these passageways being preferably located only in the middle portion of the nozzle manifold. The advantage of this embodiment is, on the one hand, that it provides a smooth surface area on which a sensitive web may never snag even when being pulled into the apparatus and, on the other hand, it results in relatively low production costs because of the simplicity involved.

While the generic term "web" has been used herein, it will be appreciated that such term in not limited to any particular material, as the invention may be just as useful hall web or web material including that of paper, textile, metal foil, synthetic plastics and the like.

What is claimed is:

1. An apparatus comprising at least one jetting section for levitational guidance and stabilization of a continuous web of material for the purpose of its heat-treatment comprising:

a) levitation nozzles for jetting the web at least on one side with a treatment gas, and b) a radial fan arranged on the jetting side of the web and including a 360° spiral housing for feeding the levitation nozzles, wherein c) said radial fan with an internal intake opening is disposed at each jetting side in the transport direction of said web respectively at one longitudinal end of each jetting section, d) said radial fan is arranged so that it delivers in a direction located substantially parallel to said transport direction of said web, and wherein e) the flow from said radial fan is returned at the respective other longitudinal end of each jetting section in the shape of a U to said web so that in the region of said levitation nozzles the flow again runs substantially parallel to said transport direction of said web as a counter current to said flow from said radial fan.

2. The apparatus as set forth in claim 1 wherein the return flow from said web occurs initially parallel to the plane of said web to a space laterally adjoining the flow ducting and from this space into the region between said flow from said radial fan and said flow at said levitation nozzles and to the intake cross-section of said radial fan.

3. The apparatus as set forth in claim 2 with jetting on both sides wherein said flow ducts guide the flow in the same direction on both sides of said web and are thus arranged mirror-symmetrical to said web.

4. The apparatus as set forth in claim 1 wherein each radial fan is of the compressor drum type and wherein a straight passageway section having roughly the length of one hydraulic diameter adjoins the delivery cross-section of its 360° spiral housing.

5. The apparatus as set forth in claim 1 wherein each of the spaces arranged on both sides of said web and said flow ducting, encompassed by the outer housing of said apparatus, are accessible for inspection and maintenance tasks.

6. The apparatus as set forth in claim 5 wherein for heating said apparatus with burners, heating means are incorporated in at least one side wall of said outer housing and protrude into the space between the parallel opposing flow sections, or for electrically heating, an electrical heating register is incorporated in the region of said U-shaped return flow.

7. The apparatus as set forth in claim 1 wherein in sections configured as closed-circuit cooling zones a cooler for a circulating gas is incorporated in the region of said U-shaped return flow, the cross-section of said ducting being flared towards the cooler inlet cross-section, as viewed from said radial fan, to increase the installation surface area.

8. The apparatus as set forth in claim 1 wherein at the web inlet and outlet openings gas jet seals are mounted at the beginning and end of said apparatus composed of jetting sections.

9. The apparatus as set forth in claim 1 wherein, for levitational guidance of said web, levitational nozzle ribs are employed, equipped with at least one of either slotted nozzles or orifice nozzles, having unequal width over the width of said web, wherein between said nozzle ribs, outflow passageways are formed permitting lateral outflow of the gas jetted to said web and wherein said levitation nozzles protrude laterally beyond the flow duct through which said levitation nozzles are supplied.

10. The apparatus as set forth in claim 9 wherein each levitation nozzle arranged transversely to said web comprises two outer nozzle slots encompassing its nozzle surface area in the form of an axial section of a double truncated cone or a barrel, the base of said double truncated cone or the largest diameter of said barrel being located in the middle of said levitation nozzle, and wherein the jets of a levitation nozzle exiting said two nozzle slots are inclined towards each other.

11. The apparatus as set forth in claim 10 wherein orifice nozzles are arranged between said nozzle slots of a levitation nozzle.

12. The apparatus as set forth in claim 9 wherein said supply duct, as viewed in the vertical longitudinal center section of said apparatus forming said U leg adjoining said web, is equipped at its side facing said web with a nozzle area comprising, in its middle region, return flow passageways passing through the nozzle manifold perpendicular to said web, said nozzle apertures being clustered around said return flow passageways.

13. The apparatus as set forth in claim 1 wherein said web to be stabilized is transported inclined with respect to the horizontal.

* * * * *